US006976754B2

(12) United States Patent
Ohashi et al.

(10) Patent No.: US 6,976,754 B2
(45) Date of Patent: Dec. 20, 2005

(54) INK JET RECORDING HEAD

(75) Inventors: Tetsuya Ohashi, Chiba (JP); Kenji Kitabatake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 10/664,926

(22) Filed: Sep. 22, 2003

(65) Prior Publication Data

US 2004/0075721 A1 Apr. 22, 2004

(30) Foreign Application Priority Data

Sep. 30, 2002 (JP) ..... 2002-287549

(51) Int. Cl.[7] ..... B41J 2/19; B41J 2/175
(52) U.S. Cl. ..... 347/92; 347/87
(58) Field of Search ..... 347/20, 63, 65, 347/85, 87, 92, 94

(56) References Cited

U.S. PATENT DOCUMENTS

| | | | | |
|---|---|---|---|---|
| 5,777,649 | A * | 7/1998 | Otsuka et al. | 347/94 |
| 6,007,193 | A * | 12/1999 | Kashimura et al. | 347/92 |
| 6,120,139 | A * | 9/2000 | Childers et al. | 347/92 |
| 6,158,855 | A * | 12/2000 | Saikawa | 347/93 |
| 6,244,698 | B1 * | 6/2001 | Chino et al. | 347/94 |
| 6,530,641 | B2 | 3/2003 | Ohashi et al. | |
| 6,540,314 | B1 | 4/2003 | Sanada et al. | |
| 6,547,379 | B2 * | 4/2003 | Chan et al. | 347/92 |
| 6,557,989 | B1 * | 5/2003 | Hirosawa et al. | 347/87 |
| 6,582,069 | B2 | 6/2003 | Ohashi et al. | |
| 2002/0075357 | A1 | 6/2002 | Ohashi et al. | |
| 2003/0052950 | A1 | 3/2003 | Ohashi et al. | |

FOREIGN PATENT DOCUMENTS

| | | |
|---|---|---|
| JP | 6-210872 | 8/1994 |
| JP | 2002-144602 | 5/2002 |

* cited by examiner

*Primary Examiner*—Anh T. N. Vo
(74) *Attorney, Agent, or Firm*—Fitzpatrick, Cella, Harper & Scinto

(57) ABSTRACT

The present invention provides an ink jet recording head in which a buffer chamber connected to a liquid supply path can be cleaned effectively. The ink jet recording head includes a recording head unit having a discharge portion for discharging ink, a tank holder unit to which an ink tank for containing the ink to be discharged at the recording head unit, and a liquid supply path formed between the tank holder unit and a flow path forming member joined to the tank holder unit in order to supply the ink contained in the ink tank to the recording head unit. A buffer chamber containing gas is connected to the liquid supply path and the buffer chamber is provided with an opening portion. The opening portion is closed by joining the recording head unit to the tank holder unit by joining the recording head unit to the flow path forming member.

2 Claims, 5 Drawing Sheets

INK JET RECORDING HEAD

BACKGROUND OF THE INVENTION

1. Field of the Invention

The present invention relates to an ink jet recording head for performing a recording operation by discharging ink onto a recording medium such as a paper or cloth.

2. Related Background Art

In the past, recording apparatuses such as printers, copiers, facsimiles and the like have been designed to record an image comprised of a dot pattern onto a recording material on the basis of image information. Such recording apparatuses are divided into an ink jet type, a wire dot type, a thermal type, a laser beam type and the like on the basis of a recording system; among them, the ink jet type has an ink jet recording head which includes, in an ink liquid path, energy converting means for generating discharge energy utilizing to discharge ink and in which the ink is introduced into the liquid path from a liquid chamber through an ink supply port and the ink is flown as a liquid droplet toward a recording material by the discharge energy applied to the ink from the energy converting means thereby performing a recording operation by adhesion of the liquid droplet.

Among various recording heads, an ink jet recording head for discharging the ink by utilizing thermal energy has been put to practical use since it allows a high density arrangement of ink discharge ports for discharging the ink recording ink to form the ink droplets and it can easily be made compact. Further, in recent years, the number of nozzles included in the ink jet recording head has been increased to satisfy requirement of high speed recording.

By the way, in the recording head of ink jet type, since the ink as fluid is used, due to ink vibration caused by the ink discharging operation, vibration of a meniscus may be disturbed greatly at an opening of the discharge port, which may lead to deterioration of image quality. For example, in the ink jet recording head in which many nozzles are arranged with high density, during the recording operation, since an ink flow amount per unit time is great and an inertia force tending to shift the ink forwardly upon stopping of the discharging becomes also great, positive pressure is applied to the nozzle by such inertia force to protrude the meniscus from the nozzle. In this case, depending upon a circumstance, the ink may be dropped. Alternatively, in the condition that the meniscus is protruded, if a next recording signal is applied, good controlled ink discharging cannot be achieved, but so-called splash ink discharging in which small ink droplets are scattered is generated, with the result that the image quality may be deteriorated.

FIG. 7 is a view showing a pressure vibration wave form generated in an ink flow path by discharge pulses created when a predetermined discharging operation is performed by using a conventional ink jet recording head and FIGS. 8A, 8B and 8C are sectional views each schematically showing a state of a meniscus in the vicinity of an ink discharge port in an A section (before discharging), a B section (during discharging) and a C section (immediately after stoppage of discharging) of FIG. 7.

As shown in FIG. 7, immediately after the stoppage of the discharging, a pressure vibration amplitude a is great to generate positive pressure, and such amplitude will disturb vibration of the meniscus in the next discharging. Explaining in more detail, in the A section of FIG. 7, as shown in FIG. 8A, a stable meniscus M is formed. In this condition, when a heat generating member 53 is operated to perform the discharging operation as in the B section, a good liquid droplet 50 is generated, as shown in FIG. 8B. In the C section immediately after the discharging operation is stopped, due to an inertia force of the ink shifting toward a discharge port 51, pressure in the flow path 52 becomes great to generate positive pressure, with the result that, as shown in FIG. 8C, the meniscus M is formed to be swollen on a discharge port forming face, and, in the worst case, the ink will be dropped from the discharge port 51. Further, if the next recording signal is applied at this timing, splash discharging may occur. In order to solve an inconvenient phenomenon which is caused by the great vibration of the meniscus and which may cause the deterioration of the image quality, there has been proposed a technique in which flow resistance is adjusted by appropriately changing a diameter of a filter provided in an ink supply path extending from an ink tank to the recording head and/or a cross-sectional area of the ink flow path so that the amplitude of the vibration of the meniscus is reduced or stabilized.

As another technique for stabilizing the vibration of the meniscus, as disclosed in Japanese Patent Application Laid-open No. 6-210872, it is known to propose a technique in which a buffer chamber communicating with a common liquid chamber constituting a part of the recording head is provided so that the pressure vibration is absorbed by applying gas (for example, air) into the buffer chamber. This technique is effective as means for suppressing the pressure vibration of the ink in the recording head, and, thus, this technique is adopted in many ink jet recording heads.

In the conventional ink jet recording head in which the ink behavior as shown in FIG. 7 and FIGS. 8A to 8C is caused upon the ink discharging, in a case where the technique for adjusting the flow resistance to stabilize the vibration of the meniscus is adopted, if the flow resistance is set to be great, although the vibration of the meniscus can be improved, the ink supplying into the ink flow path (re-fill) is delayed, with the result that the discharge amount sufficient for the next discharging cannot be obtained, thereby causing poor density. On the other hand, if the flow resistance is set to be small, although the ink supplying can be on time, the amplitude of the vibration of the meniscus cannot be suppressed, with the result that the problem to be improved in nature cannot be solved well. Namely, in the case where the problem regarding the vibration of the meniscus is improved by using the technique for adjusting the flow resistance, the condition setting is limited to the limited range, with the result that a degree of freedom of the design of the ink jet recording head is decreased and unstable factors are included.

To the contrary, in the arrangement in which the buffer chamber is provided in the common liquid chamber (or in the part of the liquid supply path; the term common liquid chamber includes the part of the liquid supply path, hereinafter) within the recording head and the pressure vibration is absorbed by applying the bubbles in the buffer chamber as disclosed in the above mentioned Japanese Patent Application Laid-open No. 6-210872, the sufficient effect for suppressing the vibration of the meniscus can be obtained. However, since the buffer chamber is communicated with the common liquid chamber via the communication portion, in order to prevent the air in the buffer chamber from being exchanged to the ink, it is required that the buffer chamber be made as a closed space except for the communication portion and the liquid be hard to be entered into the buffer chamber through the communication portion by devising the design of the communication portion and the shape of the buffer chamber. Further, regarding a common liquid chamber constituting a part of a very small ink jet recording head, since the buffer chamber must be further added, there is almost no degree of freedom regarding a buffer volume and buffer configuration.

In a case that the ink jet recording head is manufactured, constructional elements must be cleaned to remove dirt or foreign matters therefrom. In a case where the constructional elements of the ink jet recording head having the above-mentioned buffer chamber is cleaned, the interior of the buffer chamber may not be cleaned sufficiently. Further, even if the interior of the buffer chamber can be cleaned, it will take a long time for drying the head after the cleaning. Further, if the cleaning is inadequate, the dirt remaining in the buffer chamber is shifted and is clogged in the ink flow path of the ink jet recording head, thereby causing poor recording.

SUMMARY OF THE INVENTION

An object of the present invention is to solve the above-mentioned problems regarding an ink jet recording head in which a buffer chamber effective to suppress vibration of a meniscus of ink is provided in a common liquid chamber. That is to say, an object of the present invention is to provide an ink jet recording head designed so that a series of steps such as a cleaning step for cleaning a buffer chamber connected to a liquid supply path to effectively suppress vibration generated in liquid in the liquid supply path upon discharging of the liquid and a drying step after the cleaning step can be performed efficiently with high accuracy.

To achieve the above object, the present invention provides an ink jet recording head comprising a recording head unit including one or plural discharge portions for discharging one or plural liquids for recording, a tank holder unit to which one or plural tanks containing one or plural liquids to be discharged in the recording head unit are mounted, a liquid supply path formed in the tank holder unit to supply the liquid contained in the tank mounted on the tank holder unit to the recording head unit, and a buffer chamber communicated with the liquid supply path and having an opening, and wherein the opening is closed by joining the recording head unit to the tank holder unit.

According to the ink jet recording head having the above-mentioned arrangement, by flowing cleaning water through the opening portion provided in the buffer chamber, the buffer chamber can be cleaned easily and positively. Thus, foreign matters which would be created in the buffer chamber during the manufacture of the recording head can be washed out effectively and positively, thereby preventing poor discharging which otherwise is caused by the foreign matters shifted to the discharge portions of the recording head to clog the discharge portions. Further, a drying operation after the cleaning can be performed efficiently. Furthermore, since the opening portion of the buffer chamber can be closed by joining the recording head unit to the tank holder unit, an additional special step for closing the opening portion is not required.

Since the opening portion is sealingly closed by joining the recording head unit to the tank holder unit and the buffer chamber is formed in the liquid supply path, the vibration generated in the liquid by discharging the liquid can be suppressed effectively. Thus, according to the ink jet recording head of the present invention, a stable discharging condition can be maintained and a high quality recorded image can be obtained.

DETAILED DESCRIPTION OF THE PREFERRED EMBODIMENTS

Now, embodiments of the present invention will be explained with reference to the accompanying drawings.

(First Embodiment)

Figure 1:
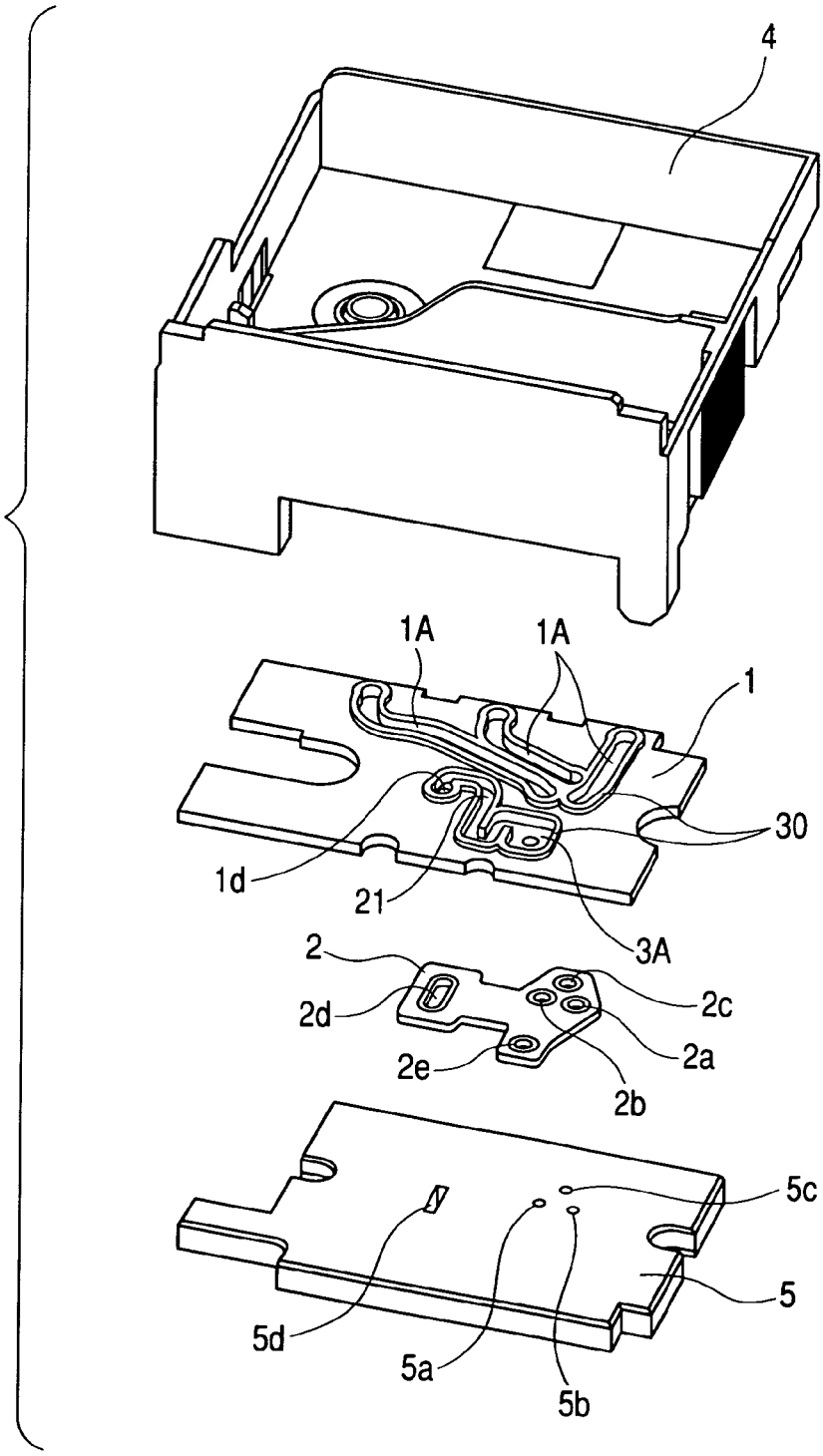
FIG. 1 is an exploded perspective view schematically showing an ink jet recording head according to a first embodiment of the present invention.
Figure 2:
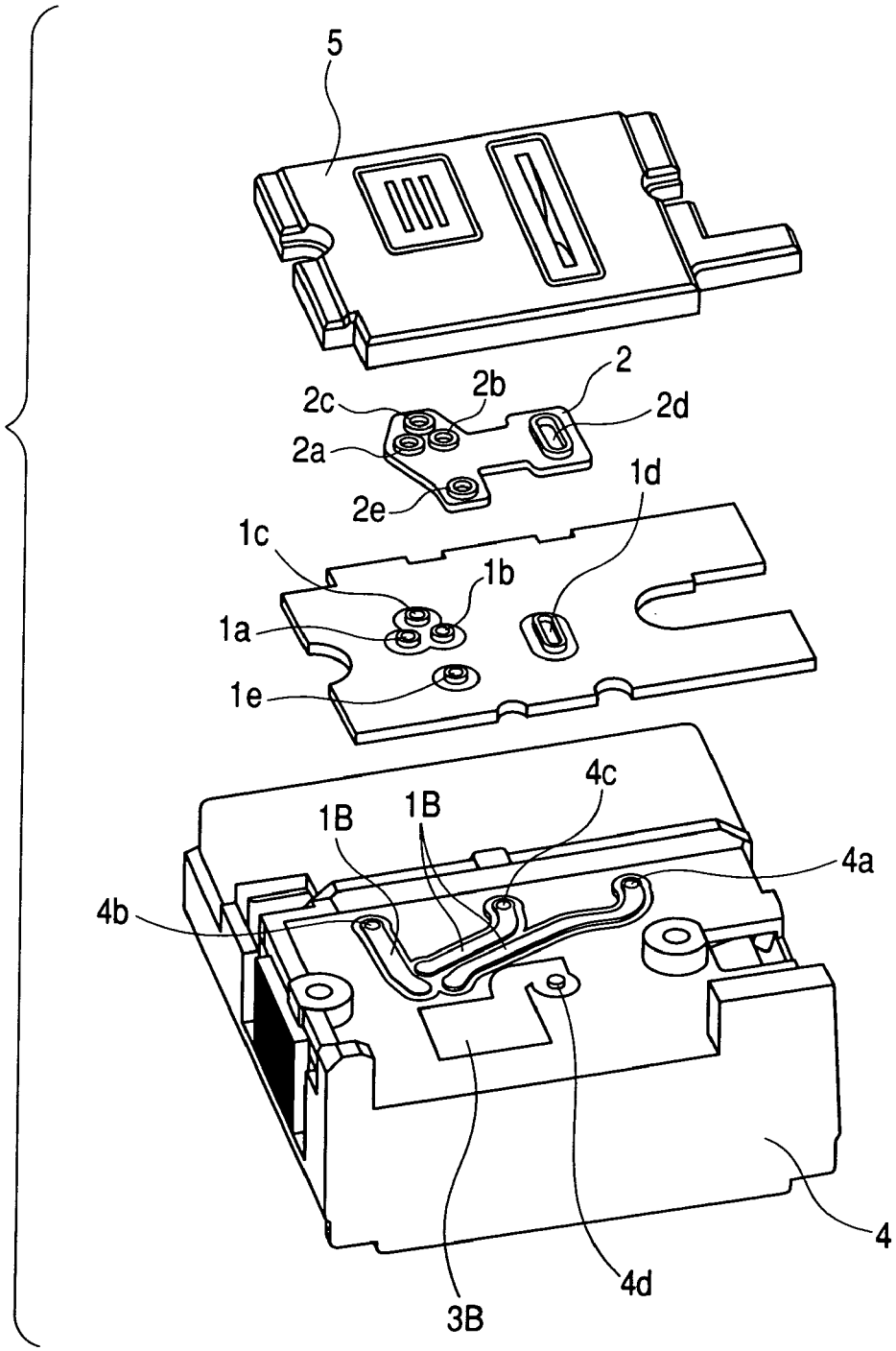
FIG. 2 is an exploded perspective view schematically showing an ink jet recording head according to a first embodiment of the present invention.

FIGS. 1 and 2 are exploded perspective views schematically showing an ink jet recording head according to a first embodiment of the present invention. FIG. 1 is a view showing the ink jet recording head, looked at from an ink tank mounting side and FIG. 2 is a view showing the ink jet recording head, looked at from a discharge port side.

As shown in FIGS. 1 and 2, the ink jet recording head according to the first embodiment comprises a recording head unit 5 including two discharge portions, i.e. a discharge portion for three color (cyan (C), magenta (M) and yellow (Y)) inks and a discharge portion for black (BK) ink, a tank holder unit 4 to which an ink tank (not shown) for color inks, constituted by integrating three ink tanks for three color inks and an ink tank (not shown) for black ink are mounted, and a flow path forming member 1 joined to the tank holder unit 4 and adapted to form liquid supply paths in the tank holder unit 4. The tank holder unit 4 and the flow path forming member 1 according to this embodiment are formed from thermoplastic resin, for example.

The tank holder unit 4 is provided with a liquid introduction outlet 4*a* for cyan ink (C), a liquid introduction outlet 4*b* for magenta ink (M), a liquid introduction outlet 4*c* for yellow ink (Y) and a liquid introduction outlet 4*d* for black ink (BK) in order to introduce the inks from the respective ink tanks mounted to the tank holder unit 4 into liquid supply path grooves 1B provided in a rear surface of the tank holder unit 4.

A liquid supply port sealing elastic member 2 as an elastic member is disposed between the flow path forming member 1 and the recording head unit 5, and the liquid supply port sealing elastic member 2 is provided with a liquid supply port 2*a* for cyan ink (C), a liquid supply port 2*b* for magenta ink (M), a liquid supply port 2*c* for yellow ink (Y) and a liquid supply port 2*d* for black ink (BK) which serve to communicate a liquid supply port 1*a* for cyan ink (C), a liquid supply port 1*b* for magenta ink (M), a liquid supply port 1*c* for yellow ink (Y) and a liquid supply port 1*d* for black ink (BK) independently provided in the flow path forming member 1 with a liquid supply port 5*a* for cyan ink (C), a liquid supply port 5*b* for magenta ink (M), a liquid supply port 5*c* for yellow ink (Y) and a liquid supply port 5*d* for black ink (BK) independently provided in the recording head unit 5, respectively.

The liquid supply ports 2*a* to 2*d* of the liquid supply port sealing elastic member 2 have through holes into which protruded portions of the liquid supply ports 1*a* to 1*d* of the flow path forming member 1 are inserted, respectively. Among edges of these through holes, edges urged by the recording head unit 5 when the flow path forming member 1 is joined to the recording head unit 5 with the interposition of the liquid supply port sealing elastic member 2 serve to seal peripheries of the liquid supply ports 5*a* to 5*d*, and edges urged by the flow path forming member 1 serve to seal peripheries of the liquid supply ports 1*a* to 1*d*.

Surfaces of the flow path forming member 1 and the tank holder unit 4, which are joined together, are provided with liquid supply path grooves 1A and 1B for forming the liquid supply paths and buffer chamber grooves 3A and 3B for forming a buffer chamber 20 (refer to FIG. 3) when the member 1 and the unit 4 are joined together. The buffer chamber 20 provides a space containing air to absorb ink vibration and is branched from the liquid supply paths via a communication path 21.

Figure 3:
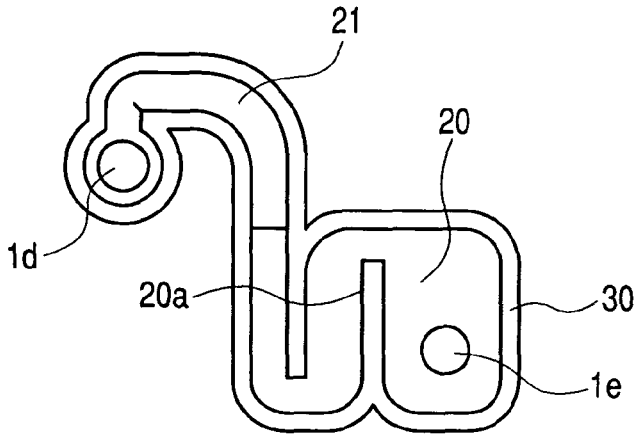
FIG. 3 is a schematic view showing a buffer chamber formed between a flow path forming member and a tank holder unit shown in FIG. 1 in an enlarged scale.

FIG. 3 is a schematic view showing the buffer chamber formed between the flow path forming member and the tank holder unit as shown in FIG. 1 and the like in an enlarged scale.

The buffer chamber 20 is provided on an extension of the communication path 21 communicated with the ink supply port 1*d* for black ink (BK) and is provided at its interior with a rib 20*a* for locally restricting a flow path cross-sectional area. The flow path forming member 1 is provided with a buffer chamber opening portion 1*e* communicated with the buffer chamber 20 so that, when the tank holder unit 4 is joined to the flow path forming member 1 to form the buffer chamber 20, the buffer chamber 20 is opened to exterior via the opening portion 1*e*.

Further, as shown in FIGS. 1 and 2, the liquid supply port sealing elastic member 2 is provided with a buffer chamber opening portion joint 2*e* corresponding to the opening portion 1*e* of the buffer chamber 20. Similar to the liquid supply ports 2*a* to 2*d*, the buffer chamber opening portion joint 2*e* is provided with a through hole into which a protruded portion of the buffer chamber opening portion 1*e* is inserted. Among edges of this through hole, an edge urged against the recording head unit 5 when the flow path forming member 1 is joined to the recording head unit 5 with the interposition of the liquid supply path sealing elastic member 2 abuts against a flat area of the recording head unit 5 where the liquid supply ports 5*a* to 5*d* are not formed, and an edge urged against the flow path forming member 1 seals a periphery of the buffer chamber opening portion 1*e*.

By joining the tank holder unit 4 to the recording head unit 5 by joining the flow path forming member 1 to the recording head unit 5 with the interposition of the liquid supply port sealing elastic member 2 in this way, the opening portion 1*e* of the buffer chamber 20 can be sealingly closed, with the result that the buffer chamber 20 which is a closed space containing the air and which is connected to the liquid supply paths via the communication path 21 is formed.

In the illustrated embodiment, welding ribs 30 are formed around the liquid supply path grooves 1A and the buffer chamber groove 3A of the flow path forming member 1 and, by welding the welding ribs to the liquid supply path grooves 1B and the buffer chamber groove 3B of the tank holder unit 4 by fusing the welding ribs by ultrasonic vibration, the tank holder unit 4 is joined to the flow path forming member 1. As means for joining the tank holder unit 4 to the flow path forming member 1, other than the above-mentioned ultrasonic vibration welding, thermal welding or adhesive bonding can be considered. However, in any cases, foreign matters such as resin pieces due to the welding and/or adhesive pieces after solidification may exist within the liquid supply path and the buffer chamber 20. If not removed, such foreign matters are shifted to the discharge ports of the recording head through the liquid supply paths, with the result that the discharge ports are clogged, thereby causing poor liquid discharging. Thus, it is required that the liquid supply paths and the buffer chamber be cleaned to remove the foreign matters. To the contrary, in the illustrated embodiment, since the opening portion 1*e* is opened to the buffer chamber 20, by flowing cleaning liquid between the liquid supply port id and the buffer chamber opening portion 1*e* through the buffer chamber opening portion 1*e*, the buffer chamber 20 can be cleaned easily and positively.

Incidentally, in the illustrated embodiment, in order to simplify FIGS. 1 and 2, while an example that the buffer chamber 20 is provided only in the liquid supply path for black ink was explained, also regarding other color inks, buffer chambers can be provided similarly.

Figure 4:
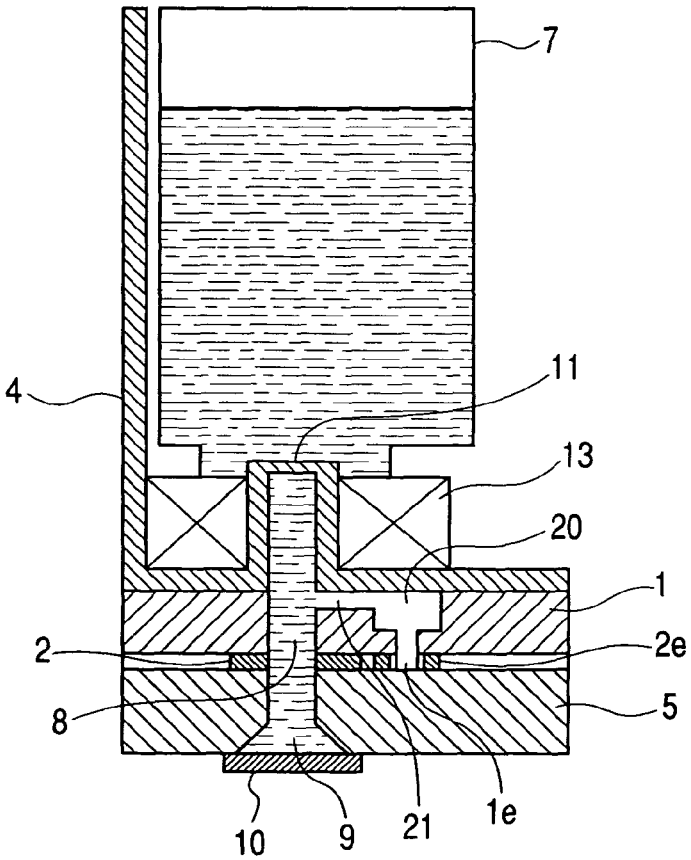
FIG. 4 is a schematic sectional view showing a liquid supply path formed in the ink jet recording head according to the first embodiment, in a condition that an ink tank is mounted.

FIG. 4 is a schematic sectional view showing the liquid supply path formed in the ink jet recording head according to the illustrated embodiment to which the ink tank is mounted.

In the ink jet recording head according to the illustrated embodiment, ink contained in the ink tank 7 mounted on the tank holder unit 4 is passed through a filter 11 provided in the tank holder unit 4 and then is supplied to a common liquid chamber 9 through the liquid supply path 8. The ink supplied to the common liquid chamber 9 is supplied to a plurality of nozzles (not shown) formed in a heater board 10 provided in the recording head unit 5 to close the common liquid chamber 9. By selectively driving heaters (not shown) provided in the heater board 10 and associated with the respective nozzles, the ink is discharged from the discharge port of the selected nozzle. In this way, the plurality of discharge ports and the nozzles formed in the heater board 10 constitute a discharge portion for discharging the ink.

Incidentally, a periphery of an ink outlet of the ink tank 7 is urged against a tank sealing elastic member 13 to prevent the ink from leaking from the ink outlet.

The above-mentioned communication path 21 is branched from the liquid supply path 8 and the buffer chamber 20 is provided on the extension of the communication path 21. The buffer chamber opening portion 1*e* for opening the buffer chamber 20 is closed by a buffer chamber opening portion joint 2*e* of the communication sealing elastic member 2 and by the flow path forming member 1 and the recording head unit 5 which urge the joint from lateral sides. Thus, since pressure vibration caused in the flow path by discharging the ink from the discharge port is absorbed by contraction of the gas within the buffer chamber 20, the discharging condition of the ink discharged from the discharge port is stabilized, thereby permitting the recording of a high quality image.

Incidentally, if the gas in the buffer chamber 20 is grown and enters into the liquid supply path 8, the gas may be pushed by the ink to be shifted from the liquid supply path 8 through the common liquid chamber into the nozzle. In this case, if the heater associated with any nozzle which is not filled with the ink is driven, not only the ink is not discharged from such a nozzle, but also the heater is seized, with the result that a phenomenon called as non-bubble discharging may occur.

To avoid this, in the illustrated embodiment, in order to give a gas barrier property to the liquid supply port sealing elastic member 2 thereby to prevent the gas from growing within the buffer chamber 20, the liquid supply port sealing elastic member 2 is made of butyl rubber chloride. In this way, in the ink jet recording head according to the illustrated embodiment, if the recording head is left as it is under the environment at a temperature of 35° C., the image can be recorded without non-bubble discharging.

Further, if the gas in the buffer chamber 20 is exchanged to the ink due to the posture and vibration of the ink jet recording head and/or reduction in ambient pressure, the pressure vibration in the flow path cannot be suppressed, thereby causing the poor recording. To avoid this, in the illustrated embodiment, as explained with reference to FIG. 3, the rib 20*a* is provided in the buffer chamber 20 to locally restrict the flow path cross-sectional area of the buffer chamber 20. Consequently, since the buffer chamber 20 is designed to have a maze and the flow path cross-sectional area is locally restricted, the ink is prevented from entering from the communication path 21 into the buffer chamber 20.

(Second Embodiment)

Figure 5:
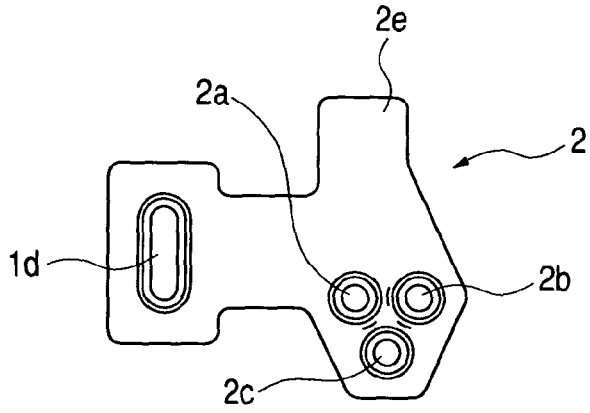
FIG. 5 is a plan view showing a liquid supply port sealing elastic member in an ink jet recording head according to a second embodiment of the present invention.
Figure 7:
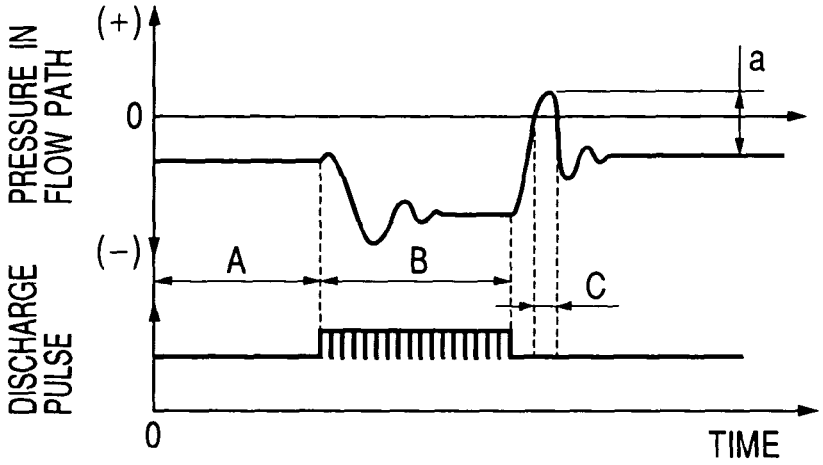
FIG. 7 is a view showing a pressure vibration wave form in an ink flow path caused by pulses applied when a predetermined discharging operation is performed in a conventional ink jet recording head.
Figure 8A:
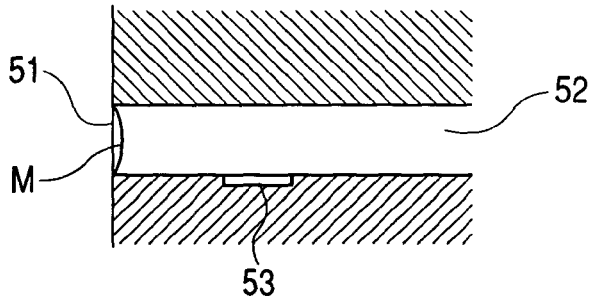
FIGS. 8A, 8B and 8C are sectional views each showing a state of a meniscus in the vicinity of an ink discharge port in an A section (before discharging), a B section (during discharging) and a C section (immediately after stoppage of discharging) of FIG. 7.
Figure 8B:
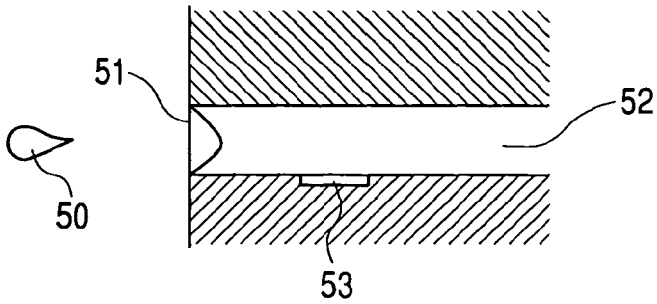
Figure 8C:
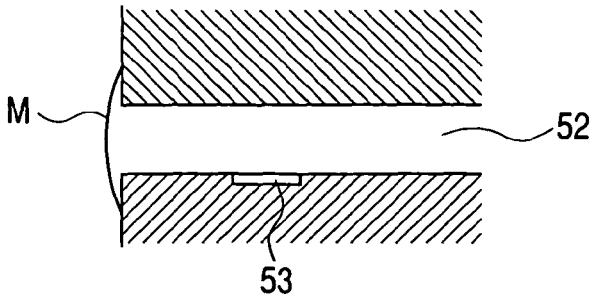

FIG. 5 is a plan view showing a liquid supply port sealing elastic member in an ink jet recording head according to a second embodiment of the present invention and FIG. 7 is a schematic sectional view showing a liquid supply path formed in the ink jet recording head according to the second embodiment to which an ink tank is mounted.

Figure 6:
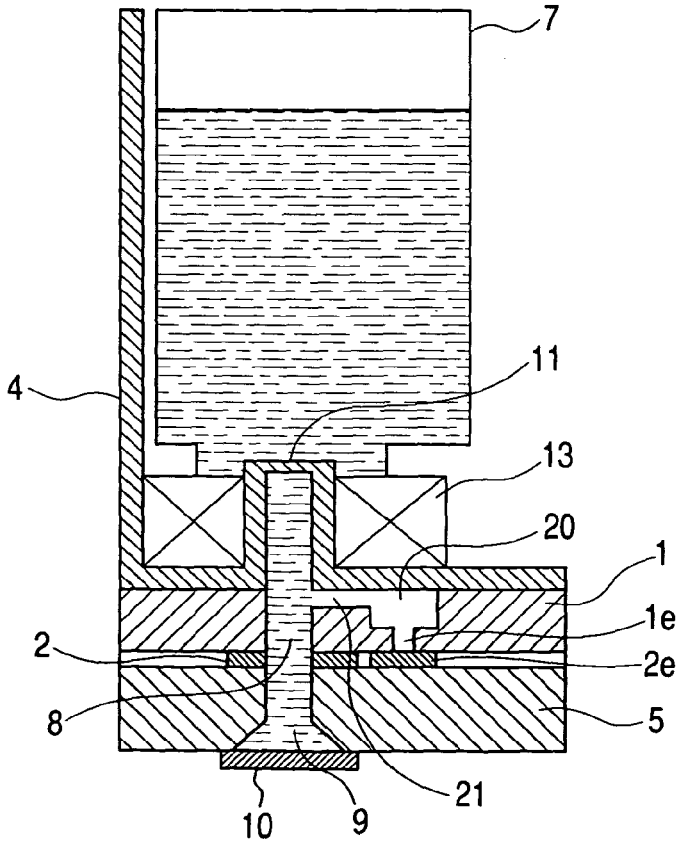
FIG. 6 is a schematic sectional view showing a liquid supply path formed in the ink jet recording head according to the second embodiment, in a condition that an ink tank is mounted.

As shown in FIGS. 5 and 6, in a liquid supply port sealing member 2 according to the second embodiment, unlike to the first embodiment, a through hole is not formed in the buffer chamber opening portion joint 2*e*, so that, by urging the buffer chamber opening portion joint 2*e* of the elastic member 2 against the buffer chamber opening portion 1*e* of the flow path forming member 1 by means of the recording head unit 5, the buffer chamber opening portion 1*e* is sealingly closed. Incidentally, since the other constructions of the ink jet recording head according to the second embodiment are the same as those in the first embodiment, detailed explanation thereof will be omitted.

If even the buffer chamber opening portion joint 2*e* is not provided in the liquid supply port sealing member 2 and the opening portion 1*e* tries to be closed by directly abutting the buffer chamber opening portion 1*e* against the recording head unit 5, depending upon smoothness of the abutting surface of the recording head unit 5, the opening portion 1*e* may not be closed adequately. To the contrary, in the second embodiment, since the opening portion 1*e* is sealingly closed by deformation of the elastic member 2, the opening portion 1*e* can be closed more positively.

With this arrangement, also in the ink jet recording head according to the second embodiment, similar to the first embodiment, since the pressure vibration generated in the flow path by the ink discharging from the discharge port is absorbed by contraction of the gas in the buffer chamber 20, the discharging condition of the ink discharged from the discharge port is stabilized, thereby permitting the high quality image recording.

Regarding the cleaning of the buffer chamber 20, since the liquid supply port sealing elastic member 2 is not urged against before the recording head unit 5 is attached to the flow path forming member 1 and the buffer chamber opening portion 1*e* is opened, similar to the first embodiment, the buffer chamber 20 can be cleaned easily.

As mentioned above, in the ink jet recording head according to the present invention, since the buffer chamber containing the gas is connected to the liquid supply paths formed in the tank holder unit and adapted to supply the liquid contained in the tank mounted on the tank holder unit to the recording head unit and the opening portion is provided in the buffer chamber, by flowing the cleaning liquid through the opening portion of the buffer chamber, the buffer chamber can be cleaned easily and positively. Thus, the foreign matters which may be produced during the manufacture of the recording head can be washed out positively and effectively, with the result that such foreign matters can be prevented from being shifted from the buffer chamber through the liquid supply paths to the discharge ports of the recording head to clog the discharge ports, thereby preventing the poor discharging. Further, the drying operation after the cleaning can be performed efficiently.

Furthermore, since the opening portion of the buffer chamber can be closed by joining the recording head unit to the tank holder unit, the additional special step for closing the opening portion is not required.

Since the opening portion is closed by joining the recording head unit to the tank holder unit and the buffer chamber containing the gas is formed in the liquid supply path, the vibration generated in the liquid within the liquid supply path by discharging the liquid can be suppressed effectively. Thus, according to the ink jet recording head of the present invention, the stable discharging condition can be maintained and the high quality recorded image can be obtained.

What is claimed is:

1. An ink jet recording head comprising:

a recording head unit having one or plural discharge ports for discharging one or plural kinds of liquids;

a tank holder unit to which one or plural tanks for containing the one or plural kinds of liquids discharged at said recording head unit are mounted;

a liquid supply path formed in said tank holder unit and adapted to supply the liquid contained in said tank mounted to said tank holder unit to said recording head unit;

a liquid supply port communicated with said liquid supply path and provided to a flow path forming member; and a buffer chamber provided to said flow path forming member, the buffer chamber having a communication path connected with said liquid supply port and having no branch, and the buffer chamber having an opening portion provided to an extension of said communication path, wherein said opening portion is closed by joining said recording head unit to said tank holder unit.

2. An ink jet recording head according to claim 1, wherein said opening portion is designed so that it is closed by an elastic member provided for communicating said liquid supply path with said recording head unit.

* * * * *